US010053814B2

(12) United States Patent
Goralski et al.

(10) Patent No.: US 10,053,814 B2
(45) Date of Patent: Aug. 21, 2018

(54) IRON WITH STEAM CHANNELS AND TEXTURED SOLEPLATE

(71) Applicant: SUNBEAM PRODUCTS, INC., Boca Raton, FL (US)

(72) Inventors: William Goralski, Delray Beach, FL (US); Channing Miller, Fort Lauderdale, FL (US); Scott Lindquist, Doral, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 15/326,196

(22) PCT Filed: Jul. 15, 2015

(86) PCT No.: PCT/US2015/040583
§ 371 (c)(1),
(2) Date: Jan. 13, 2017

(87) PCT Pub. No.: WO2016/011161
PCT Pub. Date: Jan. 21, 2016

(65) Prior Publication Data

US 2017/0204556 A1 Jul. 20, 2017

Related U.S. Application Data

(60) Provisional application No. 62/024,778, filed on Jul. 15, 2014.

(51) Int. Cl.
*D06F 75/20* (2006.01)
*D06F 75/16* (2006.01)
*D06F 75/38* (2006.01)

(52) U.S. Cl.
CPC ..... *D06F 75/20* (2013.01); *D06F 75/16* (2013.01); *D06F 75/38* (2013.01)

(58) Field of Classification Search
CPC ..... D06F 75/06; D06F 75/38; D06F 75/00; D06F 75/02; D06F 75/08–75/14; D06F 75/18–75/24; H05B 1/0255
(Continued)

(56) References Cited

U.S. PATENT DOCUMENTS 2,596,684 A * 5/1952 Hedenkamp ..... D06F 75/18 38/77.7
2,708,801 A * 5/1955 Voskresenski ..... D06F 75/18 38/77.83

(Continued)

FOREIGN PATENT DOCUMENTS

JP 09-313800 A 12/1997
KR 10-1999-0056855 A 7/1999

OTHER PUBLICATIONS

International Search Report dated Oct. 27, 2015 in PCT/US2015/040583, 2 pages.

*Primary Examiner* — Ismael Izaguirre
(74) *Attorney, Agent, or Firm* — Seth M. Blum

(57) ABSTRACT

An iron is provided including a soleplate having a first surface configured to press a fabric and deliver wrinkle releasing steam, a first plurality of steam exit holes formed in the soleplate, each of the first plurality of steam exit holes connected to an associated first steam channel formed in the first surface and connected to a centrally disposed steam channel formed in the first surface, a second plurality of steam exit holes formed in the soleplate connected to an associated second steam channel formed in the first surface connected to the centrally disposed steam channel, each of the second plurality of steam exit holes disposed symmetrically to an associated one of the first plurality of steam exit holes on an opposite side of the centrally disposed steam channel, and the centrally disposed steam channel extending substantially an elongated length of the soleplate, The sole- (Continued)

plate further includes dimples over the majority of the soleplate not covered by the steam channels.

15 Claims, 3 Drawing Sheets

(58) Field of Classification Search
USPC ..... D32/71
See application file for complete search history.

(56) References Cited

U.S. PATENT DOCUMENTS 2,724,198 A * 11/1955 Vance ..... D60F 75/18
38/77.83
2,729,004 A * 1/1956 Swanson ..... D60F 75/20
38/93
2,750,691 A * 6/1956 Parr ..... D60F 75/20
38/77.9
2,906,043 A * 9/1959 Jepson ..... D06F 75/18
38/77.7
3,045,371 A * 7/1962 Kurlinski ..... D06F 75/18
38/77.83
3,192,654 A * 7/1965 Weaver ..... D60F 75/20
38/77.9
4,658,520 A 4/1987 Henneberger et al.
5,014,454 A * 5/1991 Maurin ..... C23D 5/00
38/77.5
5,532,455 A * 7/1996 Bouleau ..... D60F 75/20
219/245
5,799,422 A * 9/1998 Demuth ..... D06F 75/38
38/93
6,189,245 B1 2/2001 Louisan et al.
6,216,369 B1 4/2001 Wolf et al.

* cited by examiner

IRON WITH STEAM CHANNELS AND TEXTURED SOLEPLATE

CROSS-REFERENCE TO RELATED APPLICATION

This application claims the benefit U.S. provisional application No. 62/024,778 filed on Jul. 15, 2014 entitled "Soleplate Texturing and Steam Channels", the entire disclosure of which is incorporated herein by reference.

FIELD OF THE INVENTION

The invention relates to an iron, and more particularly to, an iron having an improved soleplate with steam distribution channels and textured with dimples to reduce friction.

BACKGROUND OF THE INVENTION

A domestic steam iron has the capability to generate steam and to subsequently release this steam through outlet openings provided in the soleplate of the iron. The steam, which is applied directly to a garment being ironed, helps to diminish the ironing effort and to improve the ironing result. However, one drawback of such irons is that the amount of steam is limited and doesn't reach all areas of the soleplate for maximum effect on the garment.

Another known drawback of irons of this type is the soleplate is comprised of a material having a coefficient of friction which makes is difficult to move the soleplate over the garment being wrinkled.

SUMMARY OF THE INVENTION

In an embodiment, there is provided an iron including a soleplate including a first surface configured to press a fabric and deliver wrinkle releasing steam, and a first plurality of steam exit holes formed in the soleplate, each of the first plurality of steam exit holes connected to an associated first steam channel formed in the first surface and connected to a centrally disposed steam channel formed in the first surface, a second plurality of steam exit holes formed in the soleplate connected to an associated second steam channel formed in the first surface connected to the centrally disposed steam channel, each of the second plurality of steam exit holes disposed symmetrically to an associated one of the first plurality of steam exit holes on an opposite side of the centrally disposed steam channel, and the centrally disposed steam channel extending substantially an elongated length of the soleplate.

In an embodiment, there is provided an iron including a housing, a water tank disposed in the housing, a heating element, a steam generating unit configured to generate steam from water supplied from the water tank, a control switch configured to control the heating element or the steam generating unit, a soleplate attached to an underside of the housing heated by the heating element, the soleplate including a first surface configured to press a fabric and deliver wrinkle releasing steam, and a first plurality of steam exit holes formed in the soleplate, each of the first plurality of steam exit holes connected to an associated first steam channel formed in the first surface and connected to a centrally disposed steam channel formed in the first surface, a second plurality of steam exit holes formed in the soleplate connected to an associated second steam channel formed in the first surface connected to the centrally disposed steam channel, each of the second plurality of steam exit holes disposed symmetrically to an associated one of the first plurality of steam exit holes on an opposite side of the centrally disposed steam channel, and the centrally disposed steam channel extending substantially an elongated length of the soleplate.

In an embodiment, there is provided a first surface configured to press a fabric and deliver wrinkle releasing steam, and a first plurality of steam exit holes formed in the soleplate, each of the first plurality of steam exit holes connected to an associated first steam channel formed in the first surface and connected to a centrally disposed steam channel formed in the first surface, a second plurality of steam exit holes formed in the soleplate connected to an associated second steam channel formed in the first surface connected to the centrally disposed steam channel, each of the second plurality of steam exit holes disposed symmetrically to an associated one of the first plurality of steam exit holes on an opposite side of the centrally disposed steam channel, and the centrally disposed steam channel extending substantially an elongated length of the soleplate.

BRIEF DESCRIPTION OF THE DRAWINGS

A more complete understanding of the present, invention, and the attendant advantages and features thereof, will be more readily understood by reference to the following detailed description when considered in conjunction with the accompanying drawings wherein.

DETAILED DESCRIPTION OF THE INVENTION

Figure 1:
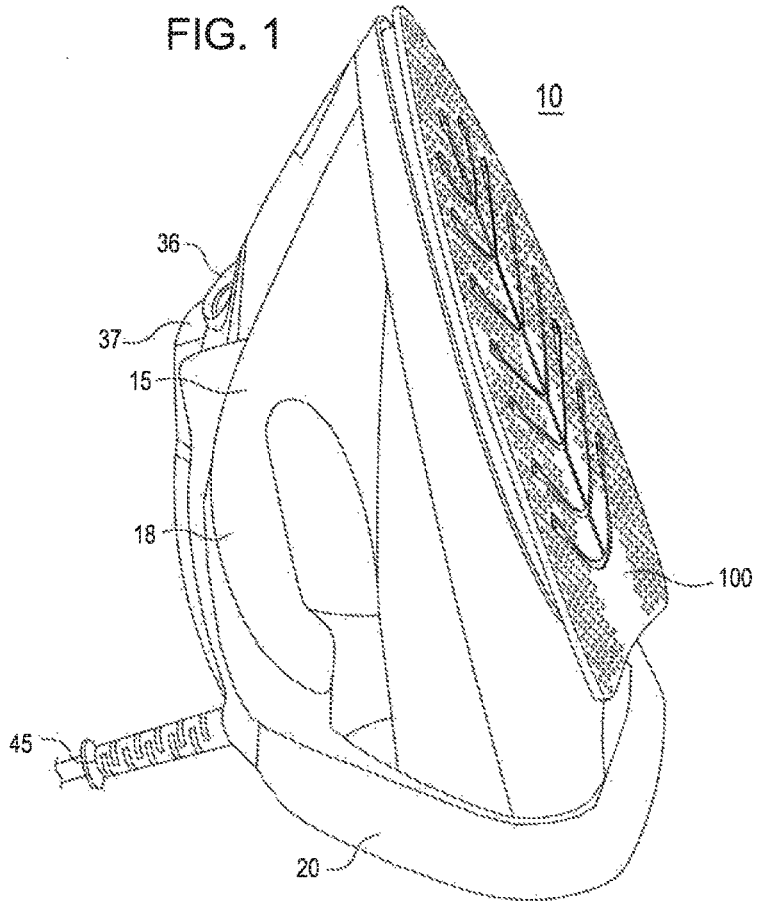
FIG. 1 is a perspective view of an iron having an embodiment of an improved soleplate with steam distribution channels and dimples.
Figure 2:
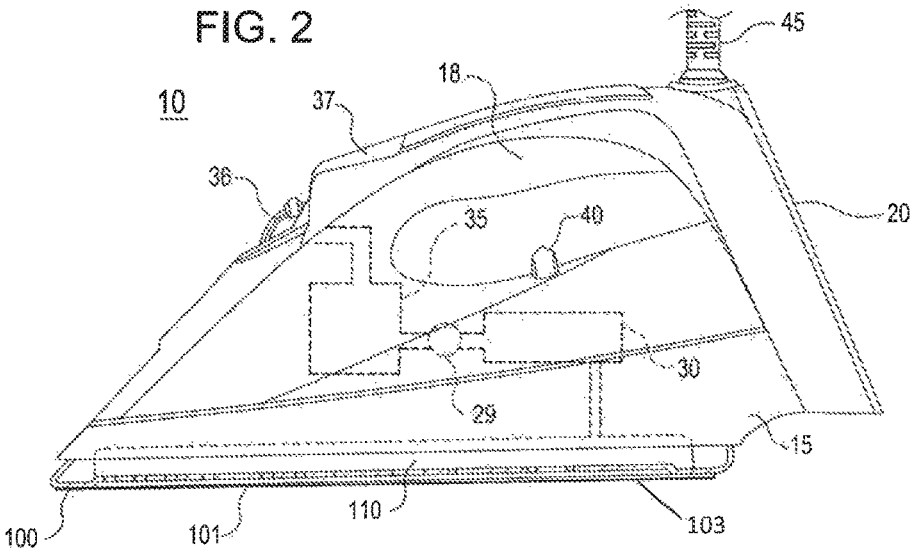
FIG. 2 is a side view of the iron of FIG. 1.

Referring now to the drawing figures in which like reference designators refer to like elements, there is shown in FIGS. 1 and 2 an iron 10 with an embodiment of an improved soleplate 100. The iron 10 is a conventional iron for pressing clothes and garments using a heated pressing surface and/or wrinkle releasing steam. There is provided a housing 15 containing electronic components including but not limited to at least one heating element 25 (FIG. 4) for heating the soleplate 100, a steam generating unit 30 for generating steam provided to the soleplate 100, optional electric pump (not shown) for pumping water from a water tank 35 to the steam generating unit 30, optional thermostat (not shown), and an electronic control 40 for controlling operation of the at least one heating element 25 (FIG. 4) and/or the steam generating unit 30. The electronic control 40 may be a slide switch, dial switch, push button switch or any other type of electrical switch or control.

The housing 15 includes a handle 18, a base 20 for resting the iron 10 on a flat surface, a fill opening 36 fluidly connected to the water tank 35 for filling the water tank 35, and a steam release button 37. The housing 15 may be made from plastic or any other suitable material. The water tank 35 is further fluidly connected to the steam generating unit 30. Water may be supplied from the water tank 35 to the steam generating unit 30 by gravity or the optional pump (not shown). The flow of water from the water tank 35 may be controlled by a solenoid valve 29 or other valve which is opened when the steam release button 37 is depressed. A similar iron having the foregoing water tank disposed in a housing is illustrated and described in U.S. Pat. No. 6,321,472, owned by a common assignee, and incorporated by reference herein in its entirety.

In an embodiment, the steam generating unit 30 is fluidly con connected to a steam channel 110 (see also FIG. 4) formed on the soleplate 100 for distribution to a plurality of steam exit openings 115*a-c* (best seen in FIG. 3) formed in the soleplate 100. When the steam release button 37 is depressed, the solenoid valve 29 is opened and water from the water tank 35 is delivered to the steam generating unit 30. Steam is thereby generated and delivered to the steam channel 110 for delivery to the plurality of steam exit openings 115*a-c*. In another embodiment, the valve 29 is eliminated and steam is generated continuously when electrical power is supplied to the steam generating unit 30.

An electrical cord 45 is attached to the housing 15 for providing electrical power from a conventional source of electrical power to the electronic control 40, at least one heating element 25, and the steam generating unit 30. When the electronic control 40 is in the power on position, the steam generating unit 30 and at least one heating element 25 is energized. The soleplate 100 is heated by the at least one heating element 25 so that a garment may be pressed using a pressing surface 101 on the bottom of soleplate 100. In addition, the steam generating unit 30 may generate steam by drawing water from water tank 35 heating it until steam is formed and delivering the steam to the steam channel 110 formed on an upper surface 102 of the soleplate 100. In an embodiment, the electronic control 40 may include a timer to shutoff the electrical power to the steam generating unit 30 and at least one heating element 25 after a designated time (for example, 30 minutes, 60 minutes or 90 minutes) for safety reasons.

Figure 3:
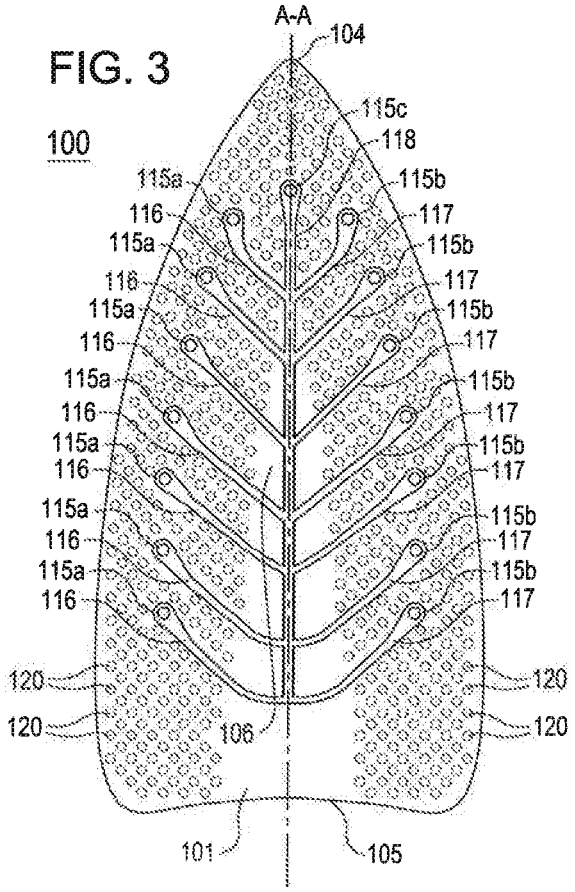
FIG. 3 is a bottom view the soleplate of the iron of FIG. 1.
Figure 4:
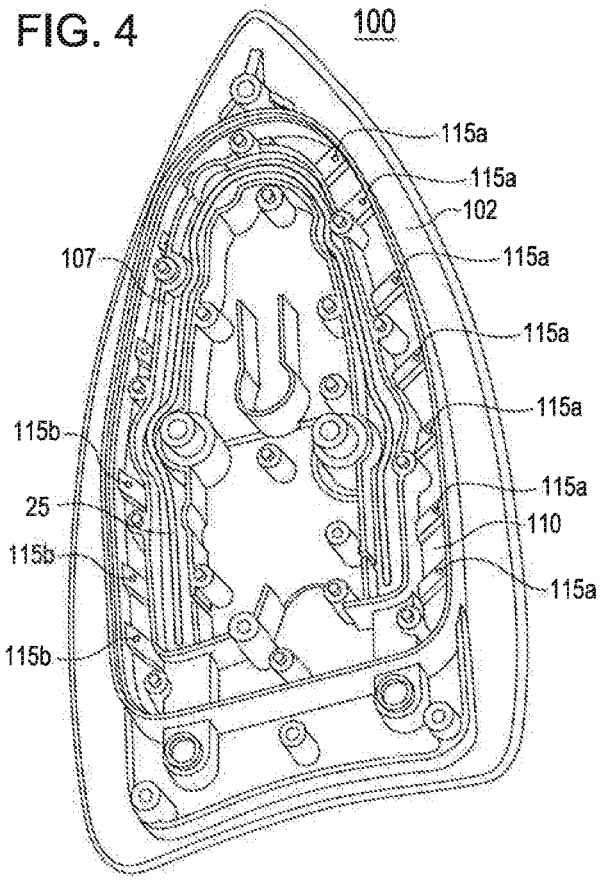
FIG. 4 is an elevated rear perspective view of the soleplate of the iron of FIG. 1.

Referring now to FIGS. 3 and 4, in an embodiment the soleplate 100 includes the plurality of steam exit holes 115*a-c* and open steam channels 116, 117 and 118. In a typical soleplate for an iron, there is no pathway for the steam to get to the center of the soleplate. As a consequence, the steam takes the easiest path to escape, which is the outside of the soleplate. In order to eliminate this problem, and with particular reference to FIG. 3, there are seven steam exit holes 115*a* disposed on one side of a centrally disposed steam channel 118. Steam channel 118 is elongated along axis A-A and extends a majority of the length of the soleplate oriented along axis A-A. The steam exit holes 115*a* are connected by downwardly extending arcuate shaped steam channels 116 to the centrally disposed steam channel 118. In addition, there are seven steam exit holes 115*b* symmetrically disposed to the steam exit holes 115*a* on an opposite side of the centrally disposed steam channel 118. These steam exit holes 115*b* are connected by downwardly extending arcuate shaped steam channels 117 to the centrally disposed steam channel 118. The steam channels 116, 117 and 118 are downwardly disposed from the soleplate 100 and open so that steam may exit therefrom into the fabric. Finally, there is a single steam exit hole 115*c* connected at one end of the centrally disposed steam channel 118 in the proximity of the tip 104 of the soleplate 104.

The opposite end of the steam channel 118 is connected to the intersection of the lowermost steam channels 116 and 117 in the proximity of the lower end 105 of the soleplate 100 opposite the tip 104. The connection of the steam exit holes 115*a-b* to the centrally disposed steam channel 118 by the steam channels 116 and 117 forms an arrangement that resembles a "tree". This arrangement is designed to deliver steam from the steam exit boles 115*a-c* via the steam channels 116, 117 and 118 to a majority of the area of the surface 101 of the soleplate 100 and in particular to the center 106 of the soleplate 100 where temperature is the greatest and the fabric is most effectively ironed.

In an embodiment, a majority of the remainder of the surface 101 of the soleplate has dimples 120 formed therein to reduce total surface contact and, thereby, reduce the coefficient of friction of the soleplate 100. The dimples 120 are very shallow so as to still produce the feel of a smooth soleplate 100. The soleplate 100 may be comprised of diecast aluminum or other suitable material and coated with a non-stick coating 103 including but not limited to a polymer, ceramic, enamel, etc. The dimples 120 and steam channels 115, 116 and 117 may be cast directly into the aluminum soleplate 100. The dimples 120 and steam channels 115, 116 and 117 together improve the ironing process.

Referring in particular to FIG. 4, there is illustrated the upper surface 102 of the soleplate 100. The heating element 25 is disposed in a groove 107 formed in the upper surface 102. In an embodiment, the heat element 25 is a tubular heating element but that is not meant to be limiting as other types of heating elements may be used. In addition, there may be additional heating elements disposed in other locations for improved performance. The groove 107 is disposed inside of the steam channel 110 and has generally the same U-shape as the steam channel 110 to maximize the heat conducting contact with the soleplate 100.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. An iron, comprising:

a housing;

a water tank disposed in the housing;

a heating element;

soleplate including a first surface configured to press a fabric and deliver wrinkle releasing steam;

a first plurality of steam exit holes formed in the soleplate, each of the first plurality of steam exit holes connected to an associated first steam channel formed in the first surface and connected to a centrally disposed steam channel formed in the first surface, a second plurality of steam exit holes formed in the soleplate connected to an associated second steam channel formed in the first surface connected to the centrally disposed steam channel, each of the second plurality of steam exit holes disposed symmetric to an associated one of the first plurality of steam exit holes on an opposite side of the centrally disposed steam channel, the centrally disposed steam channel extending substantially an elongated length of the soleplate;

a steam generating unit configured to generate steam to the plurality of steam exit holes from water supplied from the water tank; and the soleplate attached to an underside of the housing heated by the heating element.

2. The iron of claim 1, further including:

a plurality of dimples formed in the first surface of the soleplate over a substantial portion of the first surface remaining not covered by the steam exit holes and the first, second and centrally disposed steam channels, wherein the dimples are configured to reduce friction as the first surface of the soleplate is moved against the fabric.

3. The iron of claim 1, further including:

a control switch configured to control the heating element or the steam generating unit.

4. The iron of claim 1, further including;

the first surface of the soleplate covered with a coating to reduce friction as the first surface of the soleplate is moved against the fabric.

5. The iron of claim 1, further including:

the soleplate including a second surface opposite the first surface, the second surface including a third steam channel formed thereon connected to the steam generating unit configured to deliver steam from the steam generating unit to the steam exit holes.

6. The iron of claim 1, further including:

the soleplate including a second surface opposite the first surface, the second surface including a fourth channel formed thereon configured to receive the heating element and conduct heat to the soleplate.

7. An iron, comprising:

a housing;

a water tank disposed in the housing;

a heating element;

a steam generating unit configured to generate steam from water supplied from the water tank;

a control switch configured to control the heating element or the steam generating unit; a soleplate attached to an underside of the housing heated by the heating element, the soleplate including a first surface configured to press a fabric and deliver wrinkle releasing steam; and a first plurality of steam exit holes formed in the soleplate, each of the first plurality of steam exit holes connected to an associated first steam channel formed in the first surface and connected to a centrally disposed steam channel formed in the first surface, a second plurality of steam exit holes formed in the soleplate connected to an associated second steam channel formed in the first surface connected to the centrally disposed steam channel, each of the second plurality of steam exit holes disposed symmetrically to an associated one of the first plurality of steam exit holes on an opposite side of the centrally disposed steam channel, the centrally disposed steam channel extending substantially an elongated length of the soleplate.

8. The iron of claim 7, the soleplate further comprising:

a plurality of dimples formed in the first surface of the soleplate over a substantial portion of the first surface remaining not covered by the steam exit holes and the first, second and centrally disposed steam channels, wherein the dimples are configured to reduce friction as the first surface of the soleplate is moved against the fabric.

9. The iron of claim 7, the first surface of the soleplate covered with a coating to reduce friction as the first surface of the soleplate is moved against the fabric.

10. The iron of claim 7, the soleplate further including a second surface opposite the first surface, the second surface including a third steam channel formed thereon connected to the steam generating unit configured to deliver steam from the steam generating unit to the steam exit holes.

11. The iron of claim 7, the soleplate further including a second surface opposite the first surface, the second surface including a fourth channel formed thereon configured to receive the heating element and conduct heat to the soleplate.

12. A soleplate for an iron, comprising:

a first surface configured to press a fabric and deliver wrinkle releasing steam; and a first plurality of steam exit holes formed in the soleplate, each of the first plurality of steam exit holes connected to an associated first steam channel formed in the first surface and connected to a centrally disposed steam channel formed in the first surface, a second plurality of steam exit holes formed in the soleplate connected to an associated second steam channel formed in the first surface connected to the centrally disposed steam channel, each of the second plurality of steam exit holes disposed symmetrically to an associated one of the first plurality of steam exit holes on an opposite side of the centrally disposed steam channel, the centrally disposed steam channel extending substantially an elongated length of the soleplate; and a second surface opposite the first surface, the second surface including a third steam channel formed thereon connected to a steam generating unit configured to deliver steam from the steam generating unit to the steam exit holes.

13. The soleplate of claim 12, further including:

the first surface of the soleplate covered with a coating to reduce friction as the first surface of the soleplate is moved against the fabric.

14. The soleplate of claim 13, further including:

the coating selected from the group consisting of polymer, ceramic and enamel.

15. The soleplate of claim 12, wherein the second surface including a fourth channel formed thereon configured to receive the heating element and conduct heat to the soleplate.

* * * * *